US007994729B2

(12) United States Patent
Redjebian

(10) Patent No.: US 7,994,729 B2
(45) Date of Patent: Aug. 9, 2011

(54) OPTICAL ELEMENT DRIVING CIRCUIT

(75) Inventor: Berj Redjebian, Quebec (CA)

(73) Assignee: SimplexGrinnell LP, Westminster, MA (US)

( * ) Notice: Subject to any disclaimer, the term of this patent is extended or adjusted under 35 U.S.C. 154(b) by 365 days.

(21) Appl. No.: 12/256,066

(22) Filed: Oct. 22, 2008

(65) Prior Publication Data

US 2010/0013404 A1 Jan. 21, 2010

Related U.S. Application Data

(60) Provisional application No. 61/082,262, filed on Jul. 21, 2008.

(51) Int. Cl.
*H05B 41/14* (2006.01)
*H05B 39/00* (2006.01)

(52) U.S. Cl. ..... 315/241 P; 315/241 S

(58) Field of Classification Search ..... 315/241 P, 315/241 S, 200 A, 291, 307
See application file for complete search history.

(56) References Cited

U.S. PATENT DOCUMENTS

| | | | | |
|---|---|---|---|---|
| 3,864,600 | A | | 2/1975 | Schneider |
| 3,890,536 | A | | 6/1975 | Iwata |
| 3,912,968 | A | | 10/1975 | Nakamura |
| 4,145,637 | A | * | 3/1979 | Giese ..... 315/241 P |
| 4,243,917 | A | | 1/1981 | Caprari |
| 4,393,335 | A | | 7/1983 | Hirata et al. |
| 4,486,691 | A | | 12/1984 | Beggs |
| 4,618,803 | A | | 10/1986 | Hardy |
| 4,656,397 | A | | 4/1987 | Chappell et al. |
| 4,668,935 | A | | 5/1987 | McDermott |
| 4,684,852 | A | | 8/1987 | Balogh |
| 4,839,686 | A | | 6/1989 | Hosomizu et al. |
| 4,853,600 | A | | 8/1989 | Zeltner et al. |
| 4,900,990 | A | | 2/1990 | Sikora |
| 4,951,081 | A | | 8/1990 | Hosomizu et al. |
| 4,952,906 | A | | 8/1990 | Buyak et al. |
| 5,034,662 | A | | 7/1991 | Nishida et al. |
| 5,111,233 | A | | 5/1992 | Yokonuma et al. |
| 5,128,591 | A | | 7/1992 | Bocan |
| 5,140,226 | A | | 8/1992 | Lepper et al. |

(Continued)

FOREIGN PATENT DOCUMENTS

DE 40 13 879 A1 10/1991

(Continued)

OTHER PUBLICATIONS

Robert Haver, "Sidac triggers xenon flasher", *Motorola Semiconductor*, Phoenix, AZ, Jun. 14, 1984, 2 pages.

(Continued)

*Primary Examiner* — Douglas W Owens
*Assistant Examiner* — Minh D A
(74) *Attorney, Agent, or Firm* — Brinks Hofer Gilson & Lione

(57) ABSTRACT

An optical element driving circuit flexibly configures energy sources to cause illumination with an optical output element, such as a flash lamp. The energy sources include an illumination capacitor and a capacitive voltage divider circuit coupled with the optical output element. The illumination capacitor may be charged to a first voltage and a boost capacitor of the capacitive voltage divider circuit may be charged to a second voltage that is a fraction of the first voltage. The optical element driving circuit also includes a triggering circuit coupled with the capacitive voltage divider circuit. The triggering circuit is configured to place a sum of the first voltage and the second voltage across the optical output element.

21 Claims, 11 Drawing Sheets

U.S. PATENT DOCUMENTS

| | | | | |
|---|---|---|---|---|
| 5,249,007 | A | 9/1993 | Tanaka | |
| 5,264,895 | A | 11/1993 | Takahashi et al. | |
| 5,313,247 | A | 5/1994 | Hosomizu et al. | |
| 5,432,410 | A | 7/1995 | Yamada et al. | |
| 5,523,654 | A | 6/1996 | Sikora et al. | |
| 5,530,627 | A | 6/1996 | Morgan | |
| 5,570,077 | A | 10/1996 | Swieboda | |
| 5,600,186 | A | 2/1997 | Song et al. | |
| 5,602,446 | A | 2/1997 | Kolber et al. | |
| 6,031,340 | A | 2/2000 | Brosius | |
| 6,054,814 | A | 4/2000 | Constable | |
| 6,061,528 | A | 5/2000 | Ichihara et al. | |
| 6,243,001 | B1 | 6/2001 | Kodaka | |
| 6,278,382 | B1 | 8/2001 | DeMarco et al. | |
| 6,311,021 | B1 | 10/2001 | Kosich | |
| 6,411,201 | B1 | 6/2002 | Hur et al. | |
| 6,453,145 | B1 * | 9/2002 | Miura | 399/336 |
| 6,461,568 | B1 * | 10/2002 | Eckhardt | 422/24 |
| 6,518,814 | B1 | 2/2003 | Majid et al. | |
| 6,522,261 | B2 | 2/2003 | Scheffler et al. | |
| 6,661,337 | B2 | 12/2003 | Ha et al. | |
| 6,674,247 | B1 | 1/2004 | Mead et al. | |
| 6,819,059 | B2 * | 11/2004 | Block et al. | 315/241 S |
| 6,822,400 | B1 | 11/2004 | Ha et al. | |
| 6,856,241 | B1 | 2/2005 | Tice et al. | |
| 7,106,007 | B2 * | 9/2006 | Tsao | 315/241 P |
| 7,456,585 | B2 * | 11/2008 | Savage et al. | 315/241 P |
| 2002/0018652 | A1 | 2/2002 | Isozaki et al. | |
| 2002/0047626 | A1 | 4/2002 | Odaka et al. | |
| 2005/0128748 | A1 | 6/2005 | Suwa | |
| 2007/0262728 | A1 | 11/2007 | Savage et al. | |
| 2007/0263279 | A1 | 11/2007 | Savage et al. | |

FOREIGN PATENT DOCUMENTS

| | | | |
|---|---|---|---|
| DE | 41 28 551 | A1 | 3/1992 |
| GB | 2 049 318 | A | 12/1980 |
| GB | 2 060 287 | A | 4/1981 |
| GB | 2 117 193 | A | 10/1983 |

OTHER PUBLICATIONS

Rudolf F. Graf, Published by TAB Books, "Hands-on Electronics" Copyright 1991, p. 590.

Rudolf F. Graf and William Sheets, Published by TAB Books, "1992 PE Hobbyist Handbook", Copyright 1995, pp. 6-7.

Rudolf F. Graf and William Sheets, Published by TAB Books, "1991 PE Hobbyist Handbook", Copyright 1995, p. 437.

Edwards Systems Technology, Genesis Speakers and Strobes, Issue 1, Copyright 2002, 4 pages.

Wheelock Inc., Copyright 2002, 4 pages.

Take a Closer Look At Our Select-A-Strobe Family of Products, May 2000, 2 pages.

* cited by examiner

Input Connectors and EMI filtering

Trigger Synchronization Circuit

OPTICAL ELEMENT DRIVING CIRCUIT

PRIORITY CLAIM

This application claims the benefit of priority from U.S. Provisional Application No. 61/082,262, filed Jul. 21, 2008, which is incorporated by reference in its entirety.

BACKGROUND OF THE INVENTION

1. Technical Field

This application relates to optical element driving circuits and, more particularly, to setting a voltage level across an optical output element.

2. Related Art

Emergency warning systems often include visual alarms, such as strobe lights or flash lamps. Many strobe alarms include driving circuits which rely on a step-up transformer to prime a flash lamp for illumination and one or more capacitors to store energy to cause the illumination using the flash lamp. Flash lamps are designed to operate within a specified voltage range which must be met to ensure reliable flash lamp operation. Prior driving circuits sometimes employed voltage doubling circuits to drive the flash lamp and cause the illumination. However, the voltage must be carefully controlled not only to correctly generate the desired amount of illumination, but also to prevent component damaging arcing and other undesirable effects. Therefore, a need exists for an optical element driving circuit that provides reliable flash lamp operation at appropriate voltages.

SUMMARY

An optical element driving circuit flexibly configures energy sources to cause illumination with an optical output element, such as a flash lamp. In one implementation, the energy sources include an illumination capacitor and a capacitive voltage divider circuit coupled with the optical output element. The illumination capacitor may be charged to a first voltage and a boost capacitor of the capacitive voltage divider circuit may be charged to a second voltage that is a fraction (e.g., one half or one third) of the first voltage. The optical element driving circuit also includes a triggering circuit coupled with the capacitive voltage divider circuit. The triggering circuit is configured to place a sum of the first voltage and the second voltage across the optical output element.

In another implementation, an optical element driving circuit includes an illumination capacitor and a capacitive voltage divider circuit comprising multiple capacitors. The illumination capacitor and the capacitive voltage divider circuit are coupled with an optical output element. The illumination capacitor may be charged to a first voltage and the multiple capacitors of the capacitive voltage divider circuit may each be charged to the same or a different fraction of the first voltage. The optical element driving circuit also includes a controller coupled with the capacitive voltage divider circuit. The controller is configured to select zero or more capacitors from the capacitive voltage divider circuit for use to drive the optical output element.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The optical element driving circuits may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
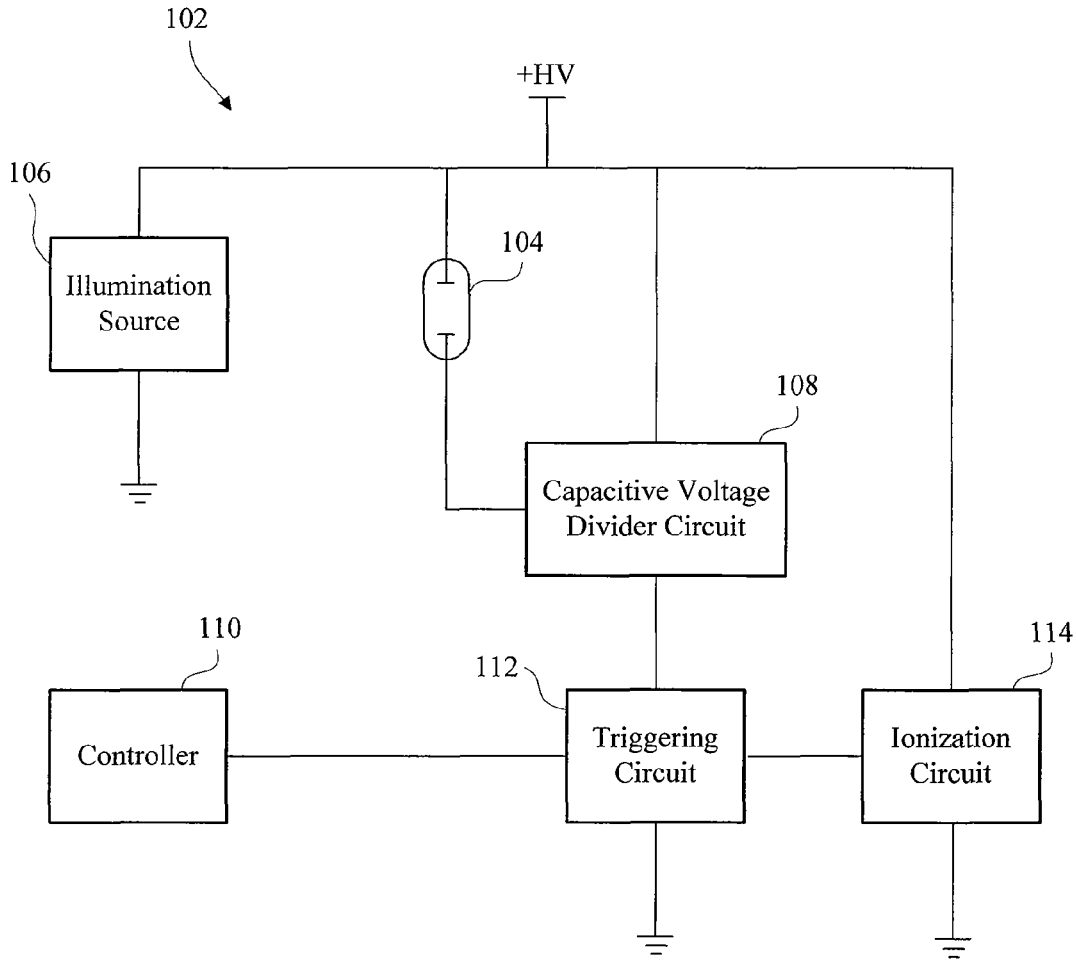
FIG. 1 is a block diagram of an optical element driving circuit.

FIG. 1 shows an optical element driving circuit 102 for an optical output element 104. In one implementation, the optical element driving circuit 102 may be a flash lamp driving circuit and the optical output element 104 may be a flash lamp, such as a xenon flash lamp. The optical element driving circuit 102 includes energy sources to drive the illumination phase of the optical output element 104. In one implementation, the energy sources include an illumination source 106 and a capacitive voltage divider circuit 108.

The voltage across the capacitive voltage divider circuit 108 as a whole is split between multiple divider capacitors within the capacitive voltage divider circuit 108. In one implementation, the multiple capacitors are connected in series. The sum of the voltages of the individual capacitors approximately equals the voltage across the capacitive voltage divider circuit 108 as a whole. In one implementation, the capacitive voltage divider circuit 108 includes two capacitors. When the two capacitors have approximately the same capacitance, then the voltages across each of the two capacitors are approximately equal, namely half of the voltage across the capacitive voltage divider circuit 108 as a whole. However, the voltage divider circuit 108 may include capacitors with different capacitances, which then charge to different voltages in relation to their capacitances. For example, if the first capacitor has twice the capacitance as the second capacitor, then the voltage across the first capacitor will be half the voltage across the second capacitor. Therefore, one-third of the total voltage will be across the first capacitor and two-thirds of the total voltage will be across the second capacitor. The amount of voltage boost for the optical output element 104 may be adjusted by changing the relative capacitances of the divider capacitors.

The optical element driving circuit 102 may also include a controller 110, a triggering circuit 112, and an ionization circuit 114. The controller 110 may determine 5 when to initialize and illuminate the optical output element 104. For example, the controller 110 may send a signal to the triggering circuit 112 and/or the ionization circuit 114 to ready the optical output element 104 for illumination. The signals to the triggering circuit 112 and the ionization circuit 114 may be sent simultaneously or sequentially. Upon receipt of the signal from the controller 110, the ionization circuit 114 causes an initial ionization of the gases inside the optical output element 104. The optical output element 104 is then primed for current flow through the optical output element 104 to generate illumination. To illuminate the optical output element 104, the triggering circuit 112 couples a boost node of the capacitive voltage divider circuit 108 to a ground potential which places zero or more capacitors of the capacitive voltage divider circuit 108 in series with the illumination source 106 across the optical output element 104 to drive the optical output element 104.

Figure 2:
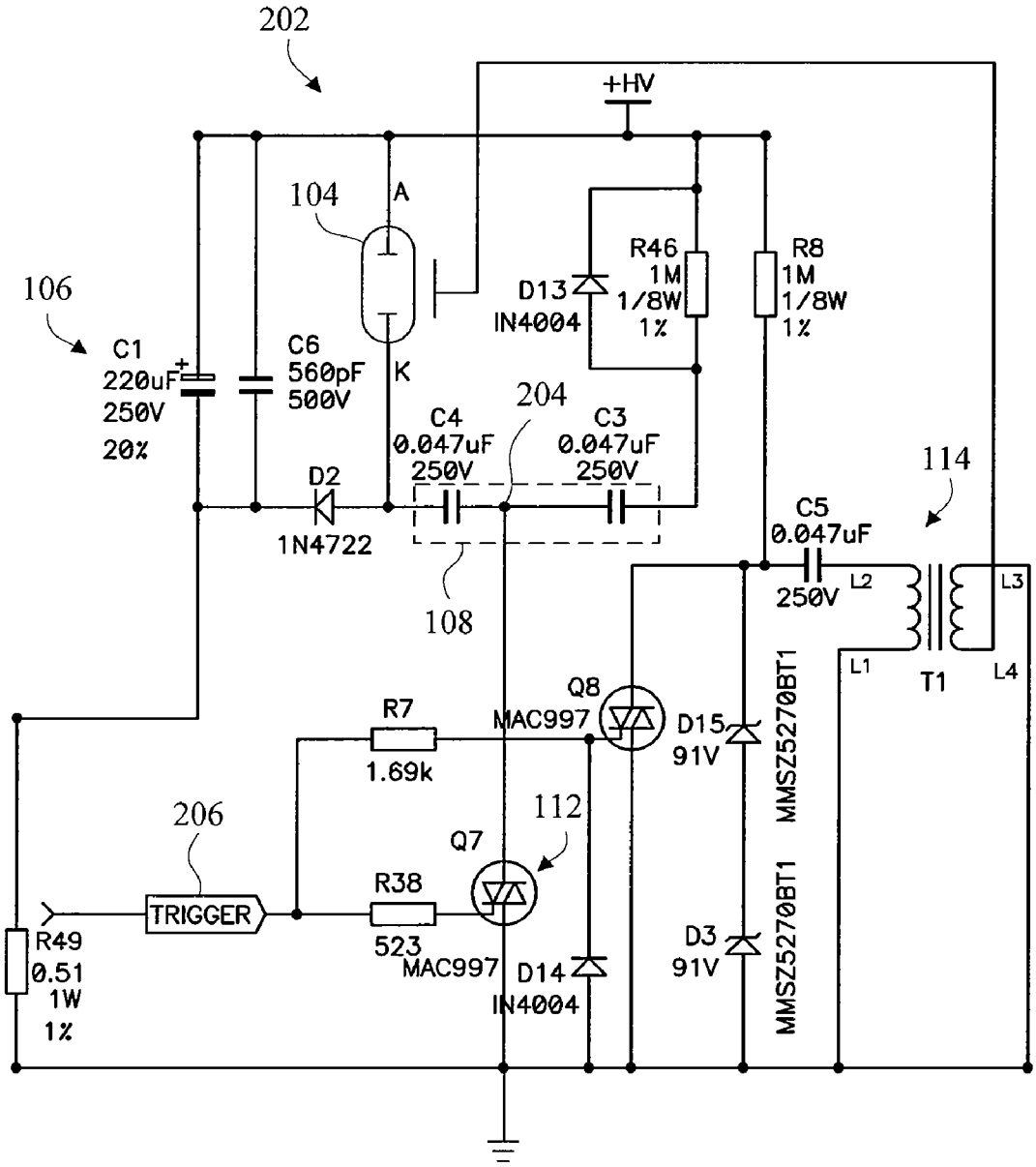
FIG. 2 is a circuit diagram of an optical element driving circuit.

FIG. 2 shows a driving circuit 202 that is one implementation of the optical element driving circuit 102 presented in FIG. 1. The driving circuit 202 of FIG. 2 produces illumination from an optical output element 104. The optical element driving circuit 102 also includes an illumination capacitor Cl and the capacitive voltage divider circuit 108 to drive the illumination phase of the optical output element 104. As described in more detail below, the capacitive voltage divider circuit 108 includes a boost node 204 which separates a capacitor C4 used to drive the optical output element 104 from a capacitor C3 that is not used to drive the optical output element 104.

The driving circuit 202 may additionally include a high frequency filter capacitor C6 connected in parallel with the illumination capacitor C1. The filter capacitor C6 may help to reduce noise in the optical element driving circuit 202. More specifically, the filter capacitor C6 may absorb high frequency transients in the charging pulses that charge the trigger capacitor C5, the illumination capacitor C1, and the capacitors C3 and C4 of the capacitive voltage divider circuit 108.

The capacitors C1, C3, C4, and C6 of the driving circuit 202 may be charged to specific voltage levels. The voltage levels may be set based on a desired output intensity for the optical output element 104. The trigger capacitor C5 may also be charged to a specific voltage level. In one implementation, two series connected 91-volt zener diodes D3 and D15 control the voltage on the trigger capacitor C5 so that it does not charge above 182 volts. Other zener values may be used to charge the trigger capacitor C5 to other voltage levels. The capacitors C1 and C6 may charge to the full voltage determined by a power source and capacitors C3 and C4 charge according to the configuration of the capacitive voltage divider circuit 108. For example, the capacitive voltage divider circuit 108 as a whole is charged to a voltage level determined by the power source, and the capacitors C3 and C4 are each charged to a portion of the total voltage across the capacitive voltage divider circuit 108.

In one implementation, C1 and C6 are charged to substantially the same voltage as the +HV voltage source. For example, if +HV is equal to 200 volts, then the potential difference across C1 and C6 is substantially equal to 200 volts minus any losses seen through the charging path. Also, the capacitive voltage divider circuit 108 is charged to substantially the same voltage as the +HV voltage source. For example, if +HV is equal to 200 volts, then the potential difference across the capacitive voltage divider circuit 108 is substantially equal to 200 volts minus any losses (e.g., the diode drop across D2) seen through the charging path. Charging current flows through a charging path to charge the capacitive voltage divider circuit 108. The charging path includes the resistor R46, capacitors C3 and C4, the diode D2, and the resistor R49.

In the implementation of FIG. 2, the capacitive voltage divider circuit 108 includes two capacitors C3 and C4. By splitting the voltage across the capacitive voltage divider circuit 108 between two or more capacitors, the driving circuit 202 implements a fractional voltage doubler circuit. The fractional voltage doubler provides the flexibility to achieve a wide range of values of electrode anode voltage across the optical output element 104 prior to ionization, without requiring full doubling of a particular source voltage.

Capacitors C3 and C4 charge from the +HV source through resistor R46. In one implementation, the +HV source provides the same charging voltage to the capacitor C1 and the capacitive voltage divider circuit 108. Thus, the total voltage across C3 and C4 combined substantially equals the voltage across C1. The voltage across C4 can be determined approximately according to equation 1 below:

$$V_{C4}=V_{CVD}[C_{C3}/(C_{C4}+C_{C3})] \quad \text{(equation 1)},$$

where $V_{CVD}$ is the voltage across the capacitive voltage divider circuit 108 as a whole, and where $C_{C3}$ and $C_{C4}$ are the capacitances of capacitors C3 and C4, respectively. If the capacitors C3 and C4 are chosen to have the same capacitance, then the voltage across C4 is approximately half of the voltage across the capacitive voltage divider circuit 108 as a whole. If the capacitor C4 is chosen to have a capacitance that is greater than the capacitance of the capacitor C3, then the voltage across C4 will be less than half of the voltage across the capacitive voltage divider circuit 108 as a whole. In one implementation, the capacitor C3 may have a capacitance that remains constant while the capacitance of the capacitor C4 is adjusted to achieve a desired voltage level across the capacitor C3. Alternatively, the capacitance of the capacitor C3 may be adjusted relative to the capacitance of the capacitor C4.

To prime the lamp 104 to provide a light output, the driving circuit 202 provides a trigger signal on a trigger input 206 to commence ionization and illumination of the optical output element 104. The trigger input 206 may be coupled with an ionization triggering circuit and an illumination triggering circuit. In one implementation, the trigger input 206 is coupled with switches Q7 and Q8. The driving circuit 202 includes a resistor R38 between the trigger input 206 and the switch Q7. The driving circuit also includes a resistor R7 between the trigger input 206 and the switch Q8. The values of the resistors R7 and R38 may be selected to ensure a desired order of switching (e.g., a staggered order). For example, the driving circuit 202 may be configured to ensure that the switch Q7 closes before the switch Q8 so that the voltage of the capacitors C1 and C4 is applied across the optical output element 104 before ionization occurs.

In one implementation, the resistance of the resistor R38 is selected to be lower than the resistance of the resistor R7. Therefore, a greater amount of current will flow to the switch Q7 than will flow to the switch Q8. Thus, the switch Q7 will begin conducting well before the switch Q8. Accordingly, the driving circuit 202 ensures that the illumination phase occurs without substantial delay after ionization. In the implementation shown in FIG. 2, R38 is 523 Ohms and R7 is 1.69 kOhms. However, other values may be selected for the resistors R7 and R38 to select the drive level applied to the switches that control triggering and illumination, and the order in which the switches are activated. Furthermore, switches Q7 and Q8 may be thyristors, triacs, silicon controlled rectifiers ("SCRs"), or other types of switching devices.

The trigger signal on the trigger input 206 causes the switch Q8 to conduct, thereby completing a circuit for the trigger capacitor C5 to energize the primary coil of the step-up transformer T1 of the ionization circuit 114. The secondary winding of the transformer T1 includes a first lead L3 connected to ground and a second lead L4 coupled with the optical output element 104. Specifically, the lead L4 may be wrapped around the optical output element 104. The secondary winding of the transformer generates a damped multi-KV oscillation applied to the outside of the lamp 104. In one implementation, the voltage developed across the pair of leads in the secondary winding of the transformer has a nominal output of approximately 5,800 volts at 185 candela output. The high voltage output of the transformer secondary winding causes an initial ionization of the gases inside the lamp 104. The lamp 104 is then primed for high current discharge flow to generate illumination.

The capacitor C1 may be considered an illumination capacitor as it provides a source of illumination energy to the optical output element 104. Capacitor C4 may be considered a boost capacitor (e.g., a fractional doubling capacitor) as it adds to or boosts the voltage provided by the illumination capacitor C1 for driving the illumination phase of the optical output element 104. Capacitor C3 may be considered a divider capacitor as it splits the total voltage of the capacitive voltage divider circuit 108 with the capacitor C4. Illumination occurs when the illumination capacitor C1 and the boost capacitor C4 drive the optical output element 104 after the trigger signal causes switch Q7 to conduct. One terminal of the switch Q7 is coupled with a ground potential. A second terminal of the switch Q7 is coupled with the boost node 204 between the capacitors C3 and C4. The trigger signal on the trigger input 206 causes the switch Q7 to conduct, thereby bringing the boost node 204 between the capacitors C3 and C4 substantially near a ground potential.

A first side of capacitor C4 is coupled with the boost node 204 between the capacitors C3 and C4. A second side of the capacitor C4 is coupled with the cathode (K) side of the optical output element 104. When the first side of the capacitor C4 at the boost node 204 is brought down to near ground potential, the second side of the capacitor C4 at the node between the boost capacitor C4 and the optical output element 104 is level shifted down to a negative voltage level. The voltage at the anode (A) of the optical output element 104 is held at a positive voltage by the illumination capacitor C1, and the voltage at the cathode (K) of the optical output element 104 is held at a negative voltage by the boost capacitor C4. Therefore, the potential difference across the optical output element 104 is approximately equal to the sum of the voltage across C1 and the voltage across C4.

When the switch Q7 is conducting, the boost capacitor C4 is placed in series with the illumination capacitor C1 to drive the optical output element 104. The boost capacitor C4 may still be considered in "series" with the illumination capacitor C1 even though some current may be flowing through the capacitor C6. Specifically, switch Q7 may place the boost capacitor C4 in series with the set of capacitors (e.g., capacitors C1 and C6) that drive the optical output element 104. By connecting the boost node 204 between the capacitors C3 and C4 with the ground potential, the switch Q7 specifically selects the voltage across capacitor C4 to add in series across the lamp, and prevents the voltage across the capacitor C3 from being placed in series with the illumination capacitor C1.

In one implementation where the capacitive voltage divider circuit 108 includes two capacitors of equal capacitance (e.g., 0.047 uF capacitors C3 and C4), the boost voltage provided by the boost capacitor C4 is determined approximately according to equation 2 below:

$$V_{Boost}=(V_{+HV}-V_R)/2 \quad \text{(equation 2)},$$

where $V_{+HV}$ is the voltage level of the fully charged illumination capacitor C1, and where $V_R$ is the residual (terminal) voltage across the illumination capacitor C1 after the illumination phase of the optical output element 104. If $V_{+HV}$ equals 225 volts and $V_R$ equals 35 volts, the boost voltage provided by the boost capacitor C4 equals approximately 95 volts. Therefore, with the boost voltage from the boost capacitor C4, the total voltage developed across the optical output element 104 prior triggering is 225 volts−(−95 volts)=320 volts. For high candela applications, where the optical output element 104 may be specified to operate with a potential difference in the range of 250 to 390 volts, the boost voltage from the capacitor C4 raises the total voltage from 225 (which is below the specified operation range) to 320 (which is within the specified operation range). Therefore, the boost capacitor C4 may help ensure reliable flash lamp operation.

In another implementation where the capacitive voltage divider circuit 108 includes more than two capacitors of equal capacitance, the boost voltage provided by the boost capacitor is determined approximately according to equation 3 below:

$$V_{Boost}=(V_{+HV}-V_R)/n \quad \text{(equation 3)},$$

where $V_{+HV}$ is the voltage level of the fully charged illumination capacitor C1, where $V_R$ is the residual voltage across the illumination capacitor C1 after the illumination phase of the optical output element 104, and where n is the number of capacitors of equal capacitance included in the capacitive voltage divider circuit 108. If $V_{+HV}$ equals 225 volts, $V_R$ equals 35 volts, and one of three capacitors in the capacitive voltage divider circuit 108 is used as a boost capacitor, then the boost voltage provided by the boost capacitor equals approximately 63.33 volts. Therefore, with the boost voltage from the boost capacitor, the total voltage developed across the optical output element 104 prior triggering is 225 volts−(−63.33 volts)=288.33 volts.

When the capacitor C4 is used to drive the optical output element 104, at least a portion (e.g., most) of the energy stored in capacitor C4 is discharged to initiate illumination. However, the capacitor C3 has no discharge path through the optical output element 104 during illumination. Therefore, the driving circuit 202 may provide an alternative path for the capacitor C3 to discharge prior to commencing the boost cycle to make sure the capacitor C3 conducts current to the capacitor C4 for the next charging cycle. In one implementation, the driving circuit 202 includes a diode D13 to provide a discharge path for the capacitor C3. Before capacitor C4 is recharged, the driving circuit 202 may discharge the energy from capacitor C3 through diode D13 into the illumination capacitor C1.

Before illumination occurs, a charge pump (or other power supply) may charge the illumination capacitor C1, capacitive voltage divider circuit 108 as a whole, and the boost capacitor to voltages selected according to the desired output intensity of the optical output element 104 according to any manufacturer specifications for the optical output element 104. For example, the capacitor C1 and the capacitive voltage divider circuit 108 as a whole may be charged to approximately 140 volts for a 15 candela output and approximately 185 volts for a 30 candela output. Similarly, the capacitor C1 and the capacitive voltage divider circuit 108 as a whole may be charged to approximately 250 volts for a 75 candela output and approximately 286 volts for a 110 candela output. Any of the voltages, capacitances, or types of energy sources may be modified, adjusted, or substituted to provide any desired set of output intensities.

In one implementation, the optical output element 104 operates with an anode voltage in the range of 250 to 390 volts. The triggering voltage may be approximately 200 volts or more. In the example of the optical element driving circuit 102 described above, the +HV voltage level is approximately 190 to 225 volts. To ensure that the optical output element 104 is driven with sufficient voltage for illumination, the capacitive voltage divider circuit 108 is configured to boost or add to the voltage provided by the capacitor C1 to achieve a larger total potential difference across the optical output element 104.

Figure 3:
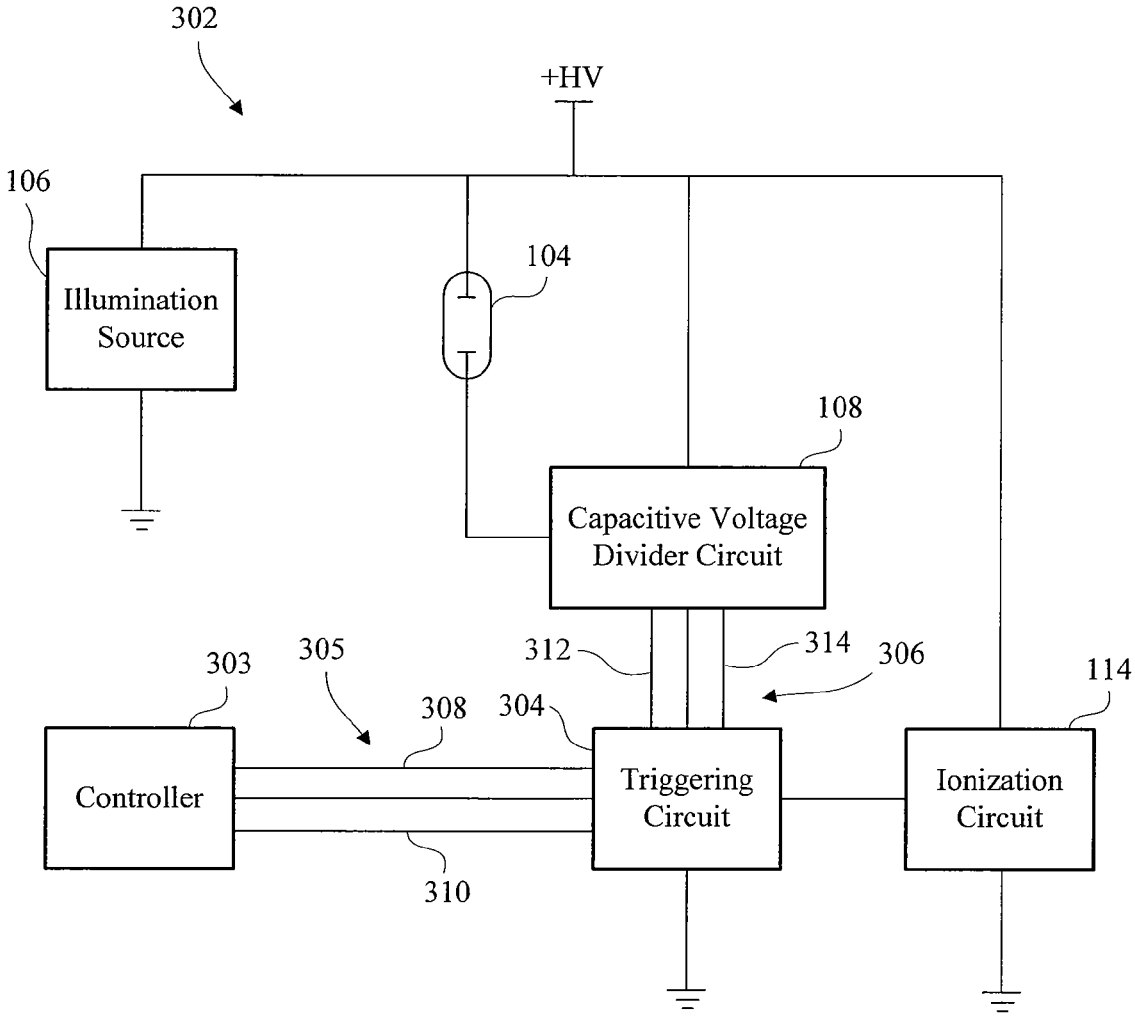
FIG. 3 is an alternative block diagram of an optical element driving circuit.

FIG. 3 shows an alternative optical element driving circuit 302 for an optical output element 104. The optical element driving circuit 302 includes one or more trigger selection connections 305 between the controller 303 and the triggering circuit 304. The trigger selection connections 305 may couple multiple trigger inputs with the triggering circuit 304. The optical element driving circuit 302 also includes one or more boost node selection connections 306 between the triggering circuit 304 and the capacitive voltage divider circuit 108. The boost node selection connections 306 may couple selected nodes in the capacitive voltage divider circuit 108 with the triggering circuit 304.

The triggering circuit 304 may couple selected boost nodes in the capacitive voltage divider circuit 108 with a ground potential. Depending on which boost node of the capacitive voltage divider circuit 108 is coupled with the ground potential, zero or more of the capacitors of the capacitive voltage divider circuit 108 will be placed in series with the illumination source 106 across the optical output element 104 to drive the optical output element 104. In the implementation described above, the capacitive voltage divider circuit 108 included two capacitors, one of which was placed in series across the lamp 104 with the illumination source 106.

In other implementations, the capacitive voltage divider circuit 108 includes more than two capacitors. Similarly, the triggering circuit 112 may drive the optical output element 104 with the voltage from zero, one, two, or more of the capacitors by selecting the appropriate node to couple with the ground potential. The amount of boost voltage applied across the optical output element 104 may be adjusted by changing the appropriate node of the capacitive voltage divider circuit 108 to couple with the ground potential so that a selected number of the divider capacitors are used to drive the optical output element 104.

In one implementation, the triggering circuit 304 includes a switch, such as a thyristor, for each of the trigger selection connections 305 and that may connect a specific boost node in the capacitive voltage divider circuit 108 to ground. For example, the optical element driving circuit 302 may include a first trigger selection connection 308 and a second trigger selection connection 310 between the controller 303 and the triggering circuit 304. The optical element driving circuit 302 may also include a first boost node selection connection 312 and a second boost node selection connection 314 between the triggering circuit 304 and the capacitive voltage divider circuit 108. The triggering circuit may include a first switch that couples the trigger selection connection 308 with the boost node selection connection 312, and a second switch that couples the trigger selection connection 310 with the boost node selection connection 314. The trigger selection connections 308 and 310 provide gate control signals to the switches of the triggering circuit 304. The trigger selection connections 312 and 314 provide a path from a selected boost node of the capacitive voltage divider circuit 108 through the switches of the triggering circuit 304 to ground when the corresponding gate control signals are asserted.

The controller 303 may then assert a trigger signal on the trigger selection connection 308 to the first switch to connect one node of the capacitive voltage divider circuit 108 (i.e., the node connected with the boost node selection connection 312) to the ground potential. Alternatively, the controller 303 may send a trigger signal on the trigger selection connection 310 to the second switch to connect a different node of the capacitive voltage divider circuit 108 (i.e., the node connected with boost node selection connection 314) to the ground potential. In other words, the controller 303 and the triggering circuit 304 may use multiple trigger paths to select the number of capacitors from the capacitive voltage divider circuit 108 to use to drive the optical output element 104.

Figure 4:
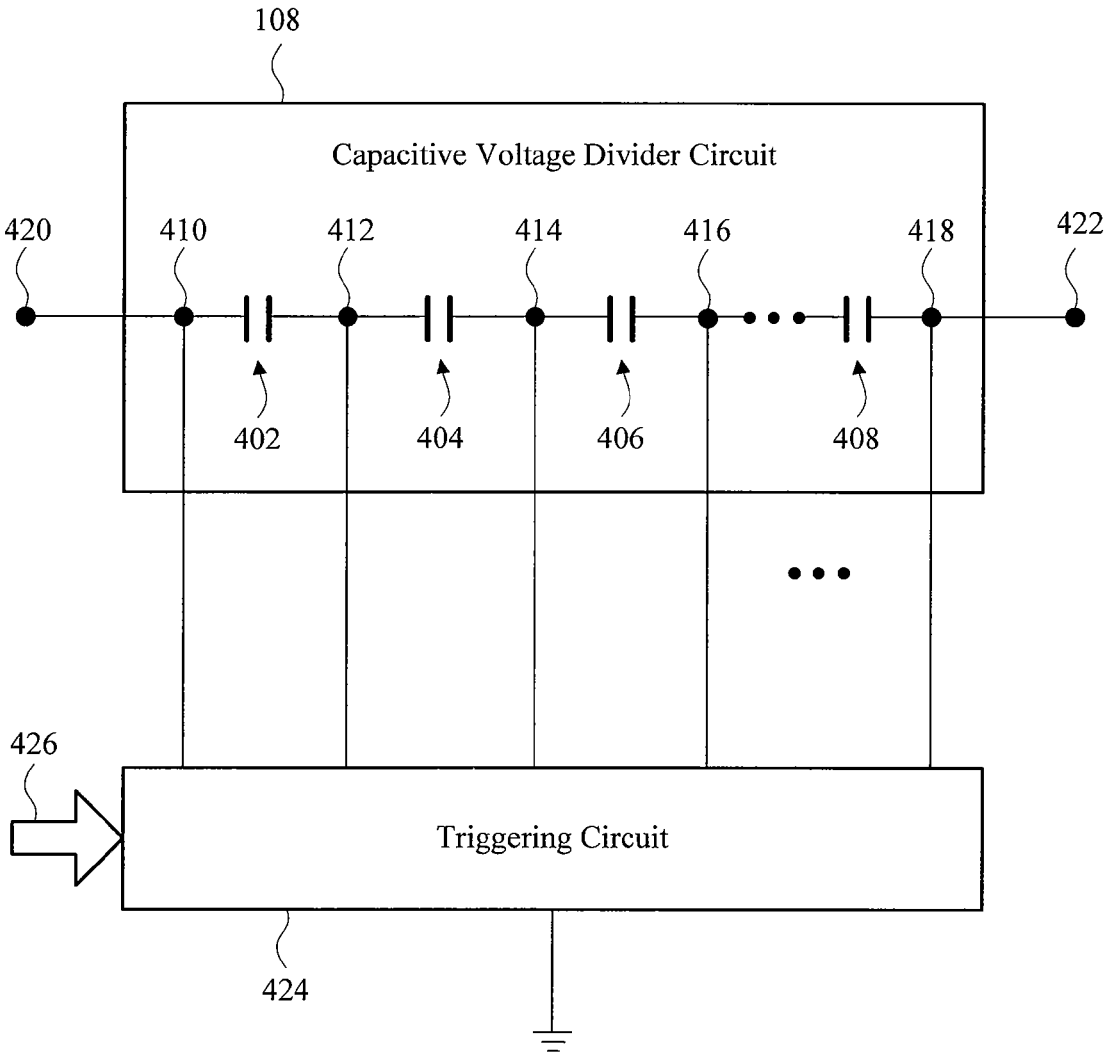
FIG. 4 is a capacitive voltage divider circuit with multiple capacitors and multiple connection nodes.

FIG. 4 shows a capacitive voltage divider circuit 108 with multiple capacitors 402, 404, 406, and 408, and multiple connection nodes 410, 412, 414, 416, and 418. Terminal 420 of the capacitive voltage divider circuit 108 is coupled with the cathode (K) of the optical output element 104 (FIG. 2), while terminal 422 is connected to a charging source (e.g., one side of resistor R46 in FIG. 2). The capacitors 402-408 may each be charged to a voltage level that is a fraction of the total voltage across the capacitive voltage divider circuit 108. The sum of the voltages of each of the capacitors 402-408 may substantially equal the total voltage across the capacitive voltage divider circuit 108. Similarly, the capacitors 402-408 may each be charged to a voltage level that is a fraction of the total voltage across the illumination capacitor C1 (FIG. 2) and the sum of the voltages of each of the capacitors 402-408 may substantially equal the total voltage across the illumination capacitor C1.

In one implementation, a triggering circuit 424 may receive an input signal 426 indicating which of the capacitors 402-408 should be used to drive the optical output element. The input signal 426 may be implemented as individual gate control signals for individual switches that are operable to couple any specific node 410-418 to ground. In another implementation, the triggering circuit 424 may receive an input signal 426 indicating which of the capacitors 402-408 should be prevented from driving the optical output element. In yet another implementation, the triggering circuit 424 may receive an input signal 426 indicating a desired voltage level to be applied across the optical output element 104 (FIG. 2). In response to the input signal 426, the triggering circuit 424 will couple one of the nodes 410-418 to a ground potential to set the appropriate voltage level across the optical output element 104. Additionally, the triggering circuit 424 may choose to select any of the nodes 410-418 to commute to ground potential to change the voltage level across the optical output element 104. For example, the triggering circuit 424 may receive an input 426 indicating that a different voltage is needed across the optical output element. In response, the triggering circuit 424 may move the ground potential from a currently selected node to a different node so that the boost voltage provided by the capacitive voltage divider circuit 108 may be adjusted to the desired level for driving the optical output element.

When the triggering circuit 424 couples the node 410 with the ground potential, none of the capacitors 402-408 of the capacitive voltage divider circuit 108 will be used to drive the optical output element. When the triggering circuit 424 couples the node 412 with the ground potential, the capacitor 402 will be used as a boost to drive the optical output element together with the illumination capacitor, but the remaining capacitors 404-408 will be prevented from driving the optical output element. When the triggering circuit 424 couples the node 414 with the ground potential, the capacitors 402 and 404 will be used as a boost to drive the optical output element together with the illumination capacitor, but the remaining capacitors 406 and 408 will be prevented from driving the optical output element. When the triggering circuit 424 couples the node 416 with the ground potential, the capacitors 402-406 will be used as a boost to drive the optical output element together with the illumination capacitor, but the remaining capacitor 408 will be prevented from driving the optical output element. When the triggering circuit 424 couples the node 418 with the ground potential, all the capacitors 402-408 of the capacitive voltage divider circuit 108 will be used as a boost to drive the optical output element together with the illumination capacitor.

Figure 5:
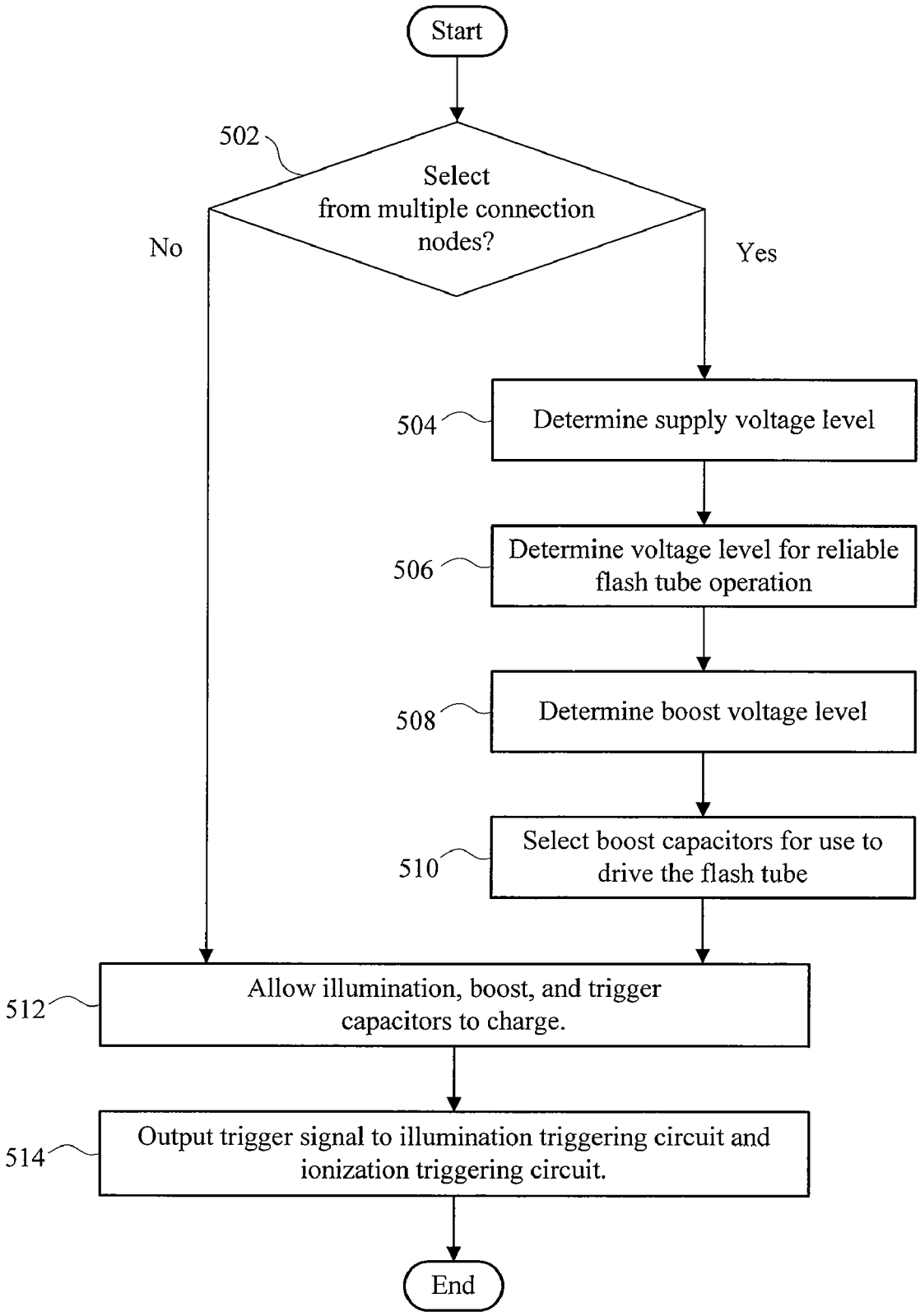
FIG. 5 is a flow diagram of the operation of a visual emergency warning system including an optical element driving circuit.

FIG. 5 is a flow diagram of the operation of a warning system including an optical element driving circuit. In some implementations, discrete circuitry in the warning system coordinates illumination through the optical output element 104. In other implementations, the warning system includes a controller that may execute an illumination control program, and the flow diagram may represent the logic implemented by the illumination control program. In such an implementation, the controller may include general purpose outputs that drive the trigger signal, boost node selection signal, or other signals under program control. The warning system determines whether multiple boost nodes in the capacitive voltage divider circuit 108 are available to select from, as described in connection with FIGS. 3 and 4 (502).

When the warning system may select from multiple boost nodes to customize the voltage level applied to the optical output element, the warning notification appliance determines the supply or illumination capacitor voltage level (504). For example, the warning system may determine the voltage level +HV used to charge the illumination source 106 and the capacitive voltage divider circuit 108. The warning system also determines the voltage level or range that would result in reliable optical output element operation (506). The warning system determines the boost voltage level (508). For example, the warning system may compare the voltage level +HV used to charge the illumination source 106 with the voltage level or range that would result in reliable flash lamp operation. The warning system selects the capacitors from the capacitive voltage divider circuit 108 to drive the optical output element (510). For example, the warning system may determine which capacitors would set (in sum with the voltage across the illumination capacitor) the voltage level across the optical output element within the reliable optical output element operation range. The warning system may then choose a specific boost node from among those available in the capacitive voltage divider circuit 108 to couple to ground so that the desired boost voltage will be used to drive the optical output element in sum with the voltage on the illumination capacitor.

Whether or not the warning system may select from multiple boost nodes, the warning system charges the illumination, boost, and trigger capacitors (512). The warning system then determines when to issue a trigger signal (514). The trigger signal initiates the ionization of the gas in the optical output element, and the illumination from the optical output element at the selected output intensity.

Figure 6:
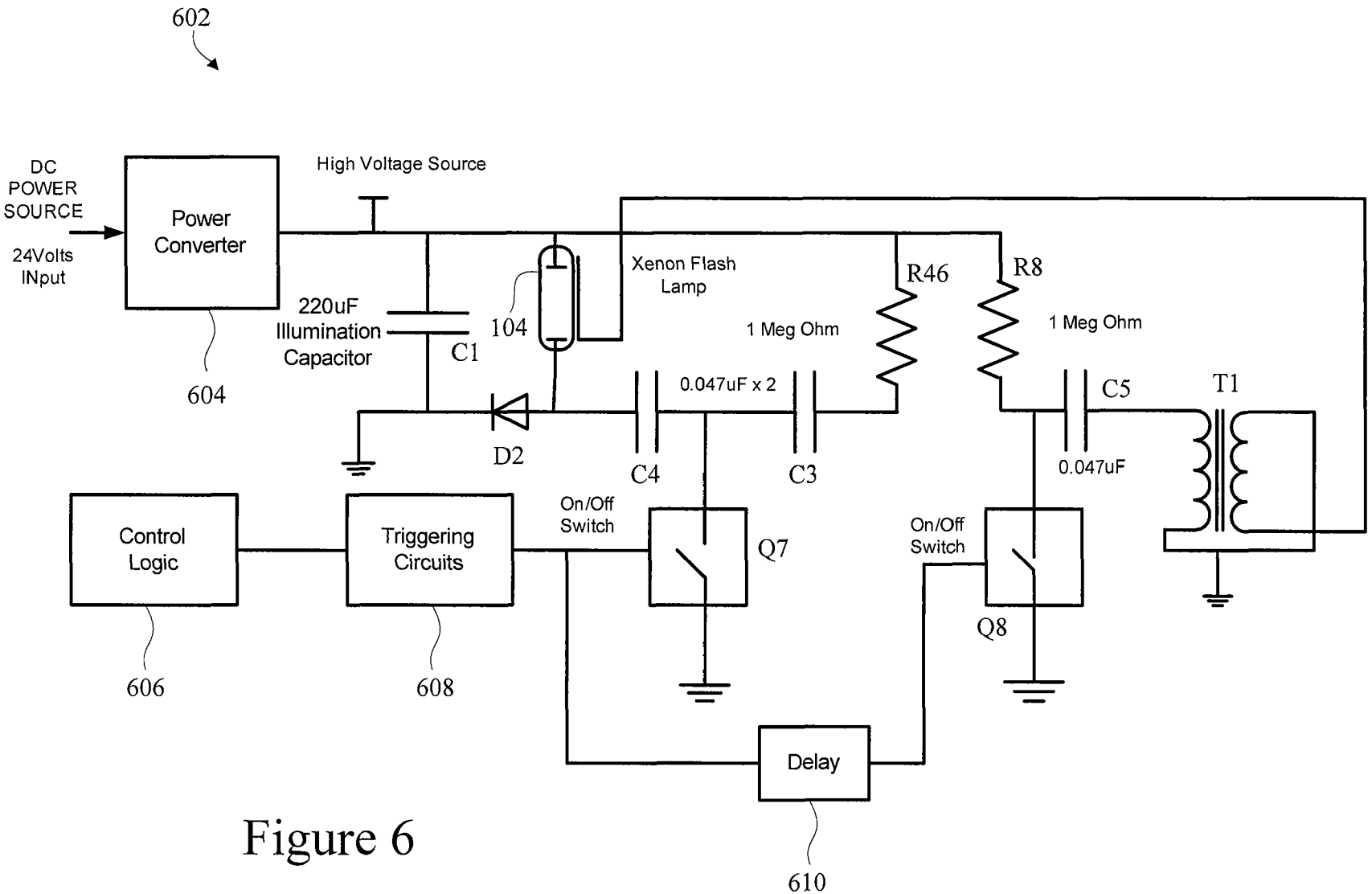
FIG. 6 is another alternative block diagram of an optical element driving circuit.

FIG. 6 shows an alternative block diagram of an optical element driving circuit 602. The optical element driving circuit 602 includes a power converter 604, control logic 606, and one or more triggering circuits 608. The control logic 606 may transmit one or more signals that close the switches Q7 and Q8. Some implementations may include a delay unit 610 to ensure that switch Q7 closes before switch Q8. By closing the switches Q7 and Q8, the control logic initiates a sequence that results in capacitors C1 and C4 producing illumination from the flash lamp 104, as described above.

Figure 7:
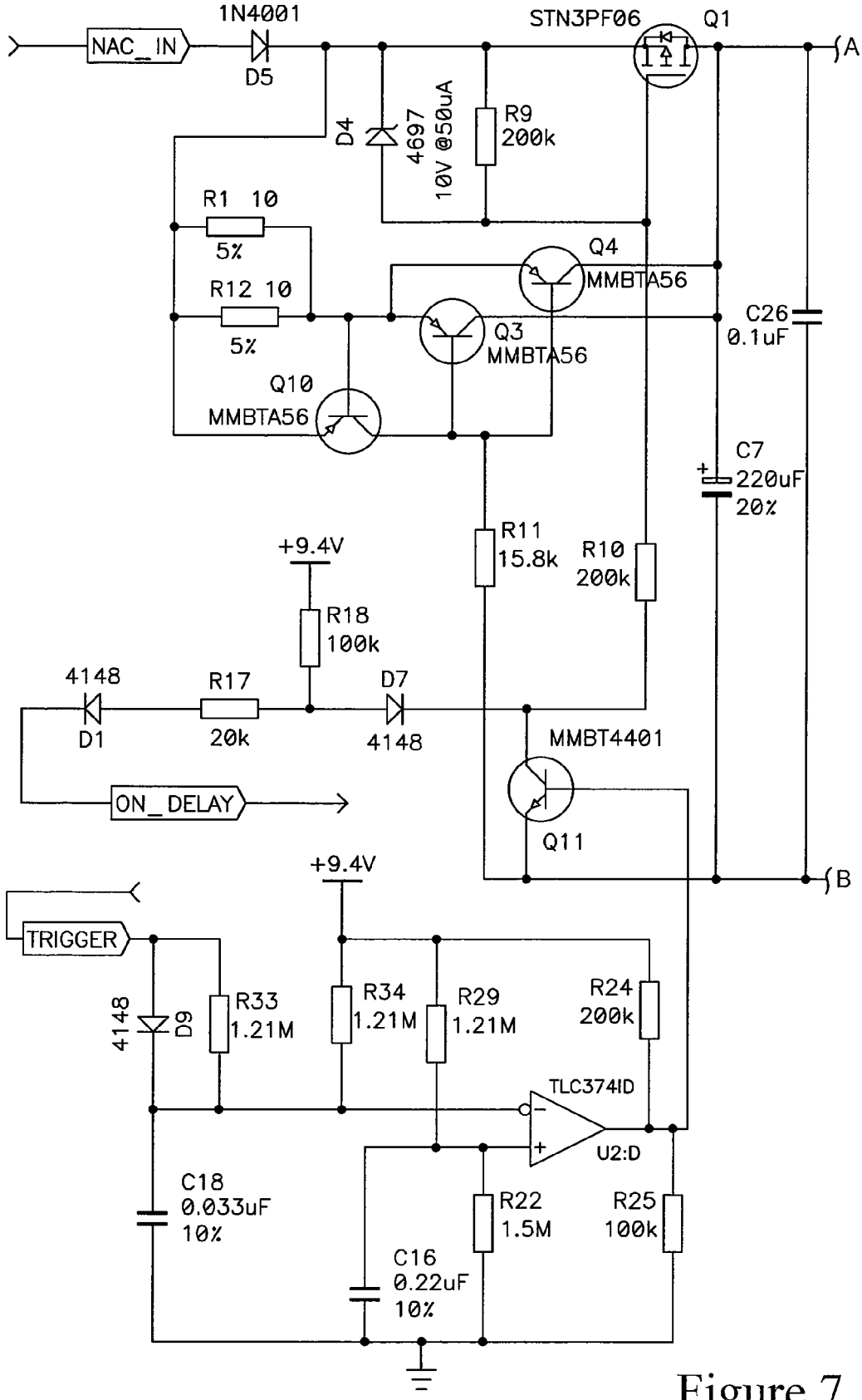
FIGS. 7-11 show an example implementation of a visual emergency warning alarm system including an optical element driving circuit.
Figure 8:
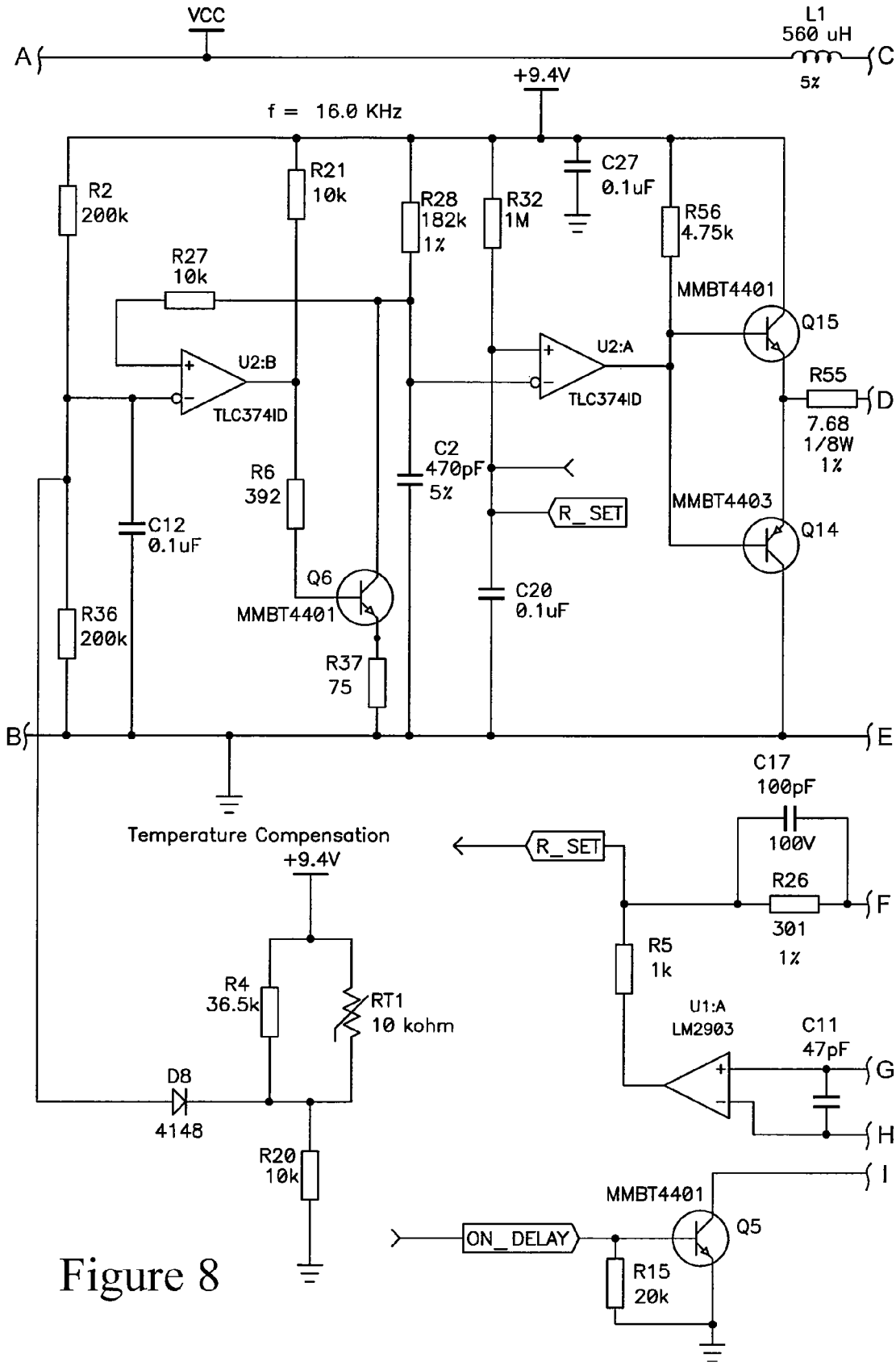
Figure 9:
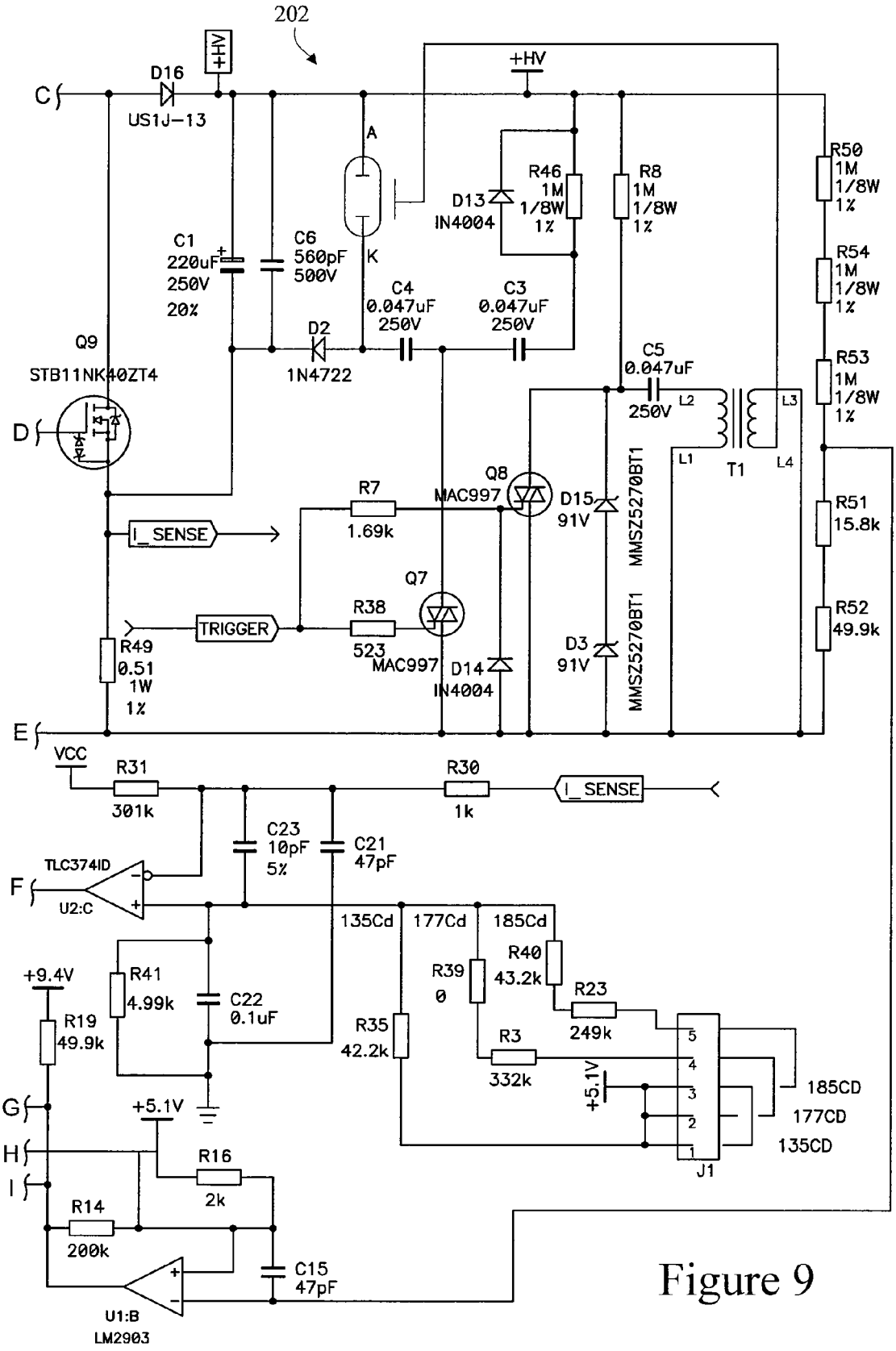
Figure 10:
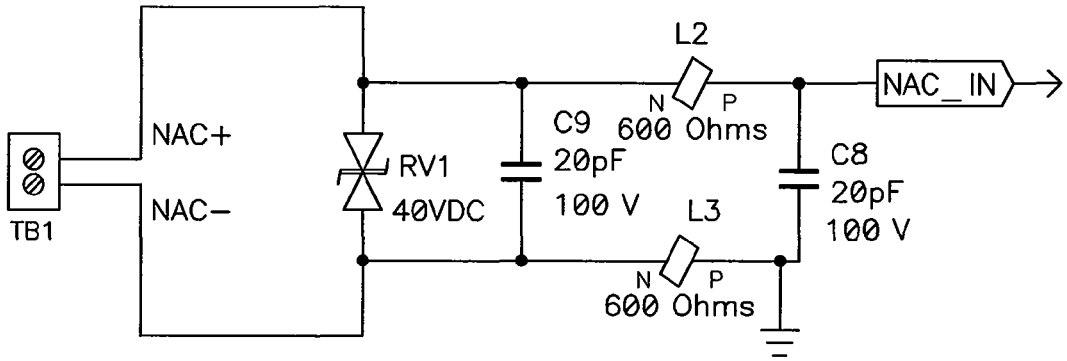
Figure 10:
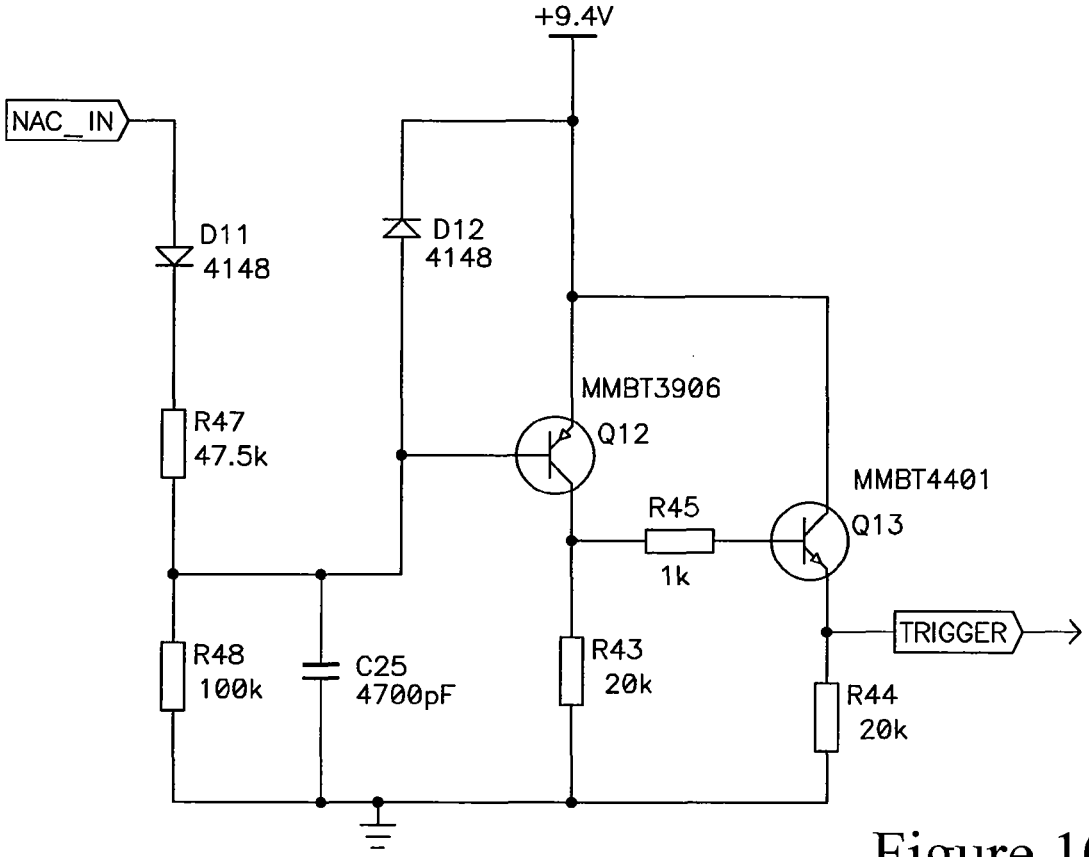
Figure 11:
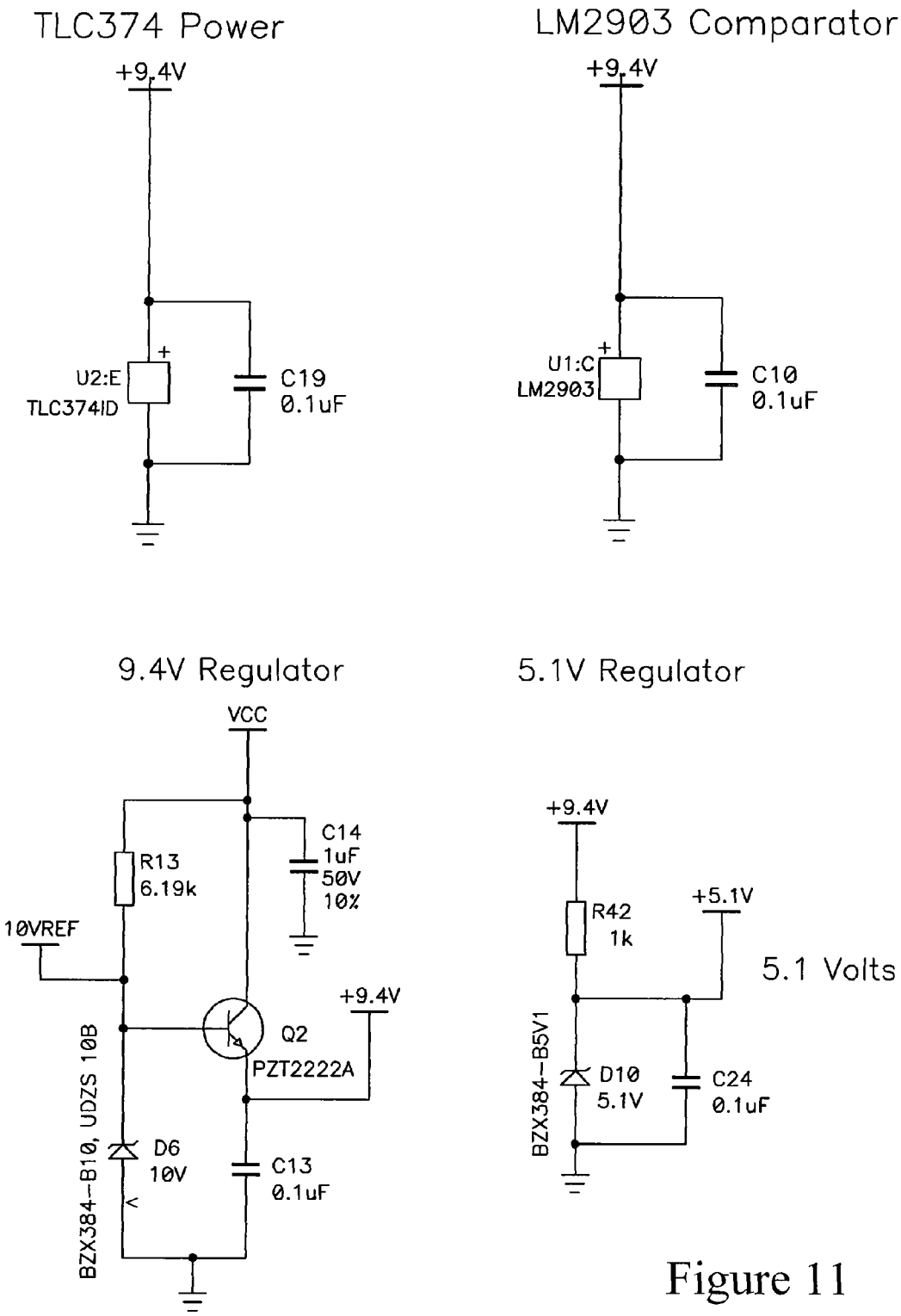

FIGS. 7-11 show a warning system that includes an optical element driving circuit 202. FIGS. 7-9 show the driving circuit 202 in the context of surrounding warning system control circuitry. FIG. 10 shows a trigger synchronization circuit, input connectors, and electromagnetic interference filtering. FIG. 11 shows power supply generation for the warning system.

The disclosed driving circuits may be modified and still fall within the spirit of the disclosure. For example, the optical output element may be any source of illumination (or energy output in the visible or non-visible spectrum), including a xenon flash lamp, flash lamp with gas, or other light source. The zener diode voltages may vary to accommodate any particular design or application. The driving circuit may produce other output intensities. Other energy sources may be used in addition to or as alternative to the capacitors. Other types of switches may be used instead of the thyristors. Resistor and capacitor values may be adjusted to accommodate other designs or specifications. The charge pump may provide another voltage level. The charge pump may be replaced with another type of power supply. The control circuitry may be analog or digital control circuitry, including discrete circuits, processors operating under programmed control, or other circuitry. Jumpers, selector switches, or other configurable circuit elements may set the desired output level and may select, for example, which of multiple boost nodes to connect to ground in the capacitive voltage divider circuit. It is therefore intended that the foregoing detailed description be regarded as illustrative rather than limiting, and that it be understood that it is the following claims, including all equivalents, that are intended to define the spirit and scope of this disclosure.

What is claimed is:

1. An optical element driving circuit comprising:

an illumination capacitor charged to a first voltage and coupled with an optical output element;

a capacitive voltage divider circuit coupled with the optical output element and comprising a boost capacitor charged to a second voltage that is a fraction of the first voltage; and a triggering circuit coupled with the capacitive voltage divider circuit and configured to place a sum of the first voltage and the second voltage across the optical output element.

2. The optical element driving circuit of claim 1, where the triggering circuit is configured to place the boost capacitor in series with the illumination capacitor to drive the optical output element.

3. The optical element driving circuit of claim 1, where the capacitive voltage divider circuit comprises the boost capacitor and a second capacitor, where the second capacitor is configured to be charged to a third voltage that is a fraction of the first voltage.

4. The optical element driving circuit of claim 3, where the triggering circuit is configured to prevent the third voltage from being applied across the optical output element.

5. The optical element driving circuit of claim 3, further comprising a discharge path configured to allow the second capacitor to discharge energy into the illumination capacitor.

6. The optical element driving circuit of claim 5, where the discharge path comprises a diode between the second capacitor and the illumination capacitor.

7. The optical element driving circuit of claim 3, where the capacitance of the boost capacitor is substantially equal to the capacitance of the second capacitor.

8. The optical element driving circuit of claim 3, where the capacitance of the boost capacitor is different than the capacitance of the second capacitor.

9. The optical element driving circuit of claim 3, where the capacitive voltage divider circuit comprises the boost capacitor, the second capacitor, and a third capacitor, where the third capacitor is configured to be charged to a fourth voltage that is a fraction of the first voltage.

10. The optical element driving circuit of claim 1, where the illumination capacitor is configured to provide a positive voltage level at a first terminal of the optical output element, where the triggering circuit is configured to use the boost capacitor to provide a negative voltage level at a second terminal of the optical output element.

11. The optical element driving circuit of claim 1, where the triggering circuit comprises an illumination triggering circuit, the optical element driving circuit further comprising:

a trigger input coupled with the illumination triggering circuit and an ionization triggering circuit;

a first resistor between the trigger input and the illumination triggering circuit; and a second resistor between the trigger input and the ionization triggering circuit, where the resistance of the first resistor is lower than the resistance of the second resistor.

12. The optical element driving circuit of claim 1, where the triggering circuit comprises a thyristor, where a first terminal of the thyristor is coupled with a ground potential, where a second terminal of the thyristor is coupled between the boost capacitor and a second capacitor of the capacitive voltage divider circuit.

13. The optical element driving circuit of claim 1, where the optical output element comprises a xenon flash lamp.

14. An optical element driving circuit comprising:

an illumination capacitor charged to a first voltage and coupled with an optical output element;

a capacitive voltage divider circuit coupled with the optical output element and comprising multiple capacitors each charged to a fraction of the first voltage; and a controller coupled with the capacitive voltage divider circuit and configured to select at least one selected capacitor from the capacitive voltage divider circuit to increase a voltage level across the optical output element above the first voltage.

15. The optical element driving circuit of claim 14, where the controller is configured to place a sum of the first voltage and a voltage of the at least one selected capacitor across the optical output element.

16. The optical element driving circuit of claim 14, where the controller is configured to place the at least one selected capacitor from the capacitive voltage divider circuit in series with the illumination capacitor to drive the optical output element; and where the controller is configured to prevent one or more unselected capacitors from the capacitive voltage divider circuit from being in series with the illumination capacitor.

17. An optical element driving circuit comprising:

an illumination capacitor charged to a first voltage and coupled with an optical output element;

a capacitive voltage divider circuit coupled with the optical output element and comprising multiple capacitors each charged to a fraction of the first voltage; and a controller coupled with the capacitive voltage divider circuit and configured to select a circuit configuration for from the capacitive voltage divider circuit for use to drive the optical output element;

where the capacitive voltage divider circuit comprises:

a first capacitor charged to a second voltage that is fraction of the first voltage;

a second capacitor charged to a third voltage that is fraction of the first voltage;

a first node between the first capacitor and the optical output element;

a second node between the first capacitor and the second capacitor; and a third node at another terminal of the second capacitor;

where the controller is configured to select the circuit configuration for from the capacitive voltage divider circuit for use to drive the optical output element by coupling a ground potential with either the first node, the second node, or the third node.

18. The optical element driving circuit of claim 17, where the controller prevents the second and third voltages from being applied across the optical output element when the controller couples the ground potential with the first node;

where the controller prevents the third voltage from being applied across the optical output element when the controller couples the ground potential with the second node; and where the controller applies both the second and third voltages across the optical output element when the controller couples the ground potential with the third node.

19. The optical element driving circuit of claim 17, where the controller is configured to move the ground potential from one of the first, second, or third nodes to another of the first, second, or third nodes when a different voltage level is desired across the optical output element.

20. A flash lamp driving circuit comprising:

an illumination capacitor configured to be charged to a first voltage and coupled with a flash lamp of a visual emergency warning device;

a capacitive voltage divider circuit coupled with the flash lamp and comprising a first capacitor and second capacitor, where the first capacitor is configured to be charged to a second voltage that is a fraction of the first voltage, where the second capacitor is configured to be charged to a third voltage that is a fraction of the first voltage; and a triggering circuit coupled with the capacitive voltage divider circuit and configured to place a sum of the first voltage and the second voltage across the flash lamp, where the triggering circuit is configured to prevent the third voltage from being placed across the flash lamp.

21. The optical element driving circuit of claim 1, where the optical output element comprises an anode terminal and a cathode terminal, and where a potential difference between the anode terminal and the cathode terminal equals the sum of the first voltage and the second voltage when a switch of the triggering circuit is in a closed circuit position.

* * * * *

UNITED STATES PATENT AND TRADEMARK OFFICE

CERTIFICATE OF CORRECTION

PATENT NO. : 7,994,729 B2
APPLICATION NO. : 12/256066
DATED : August 9, 2011
INVENTOR(S) : Berj Redjebian It is certified that error appears in the above-identified patent and that said Letters Patent is hereby corrected as shown below:

Column 12:

Claim 17

Line 9:
Whereas, "for from the capacitive..." should be corrected to read "for the capacitive..."

Line 22:
Whereas, "figuration for from the capacitive..." should be corrected to read "figuration for the capacitive..."

Signed and Sealed this
Third Day of July, 2012

David J. Kappos

David J. Kappos
*Director of the United States Patent and Trademark Office*